United States Patent [19]

Christie

[11] Patent Number: 4,726,956

[45] Date of Patent: Feb. 23, 1988

[54] TEA BAG WITH A PROTECTIVE COVER

[76] Inventor: Hugh P. Christie, 50 Bevington Road, Glenunga, South Australia, Australia

[21] Appl. No.: 899,224

[22] PCT Filed: Nov. 15, 1985

[86] PCT No.: PCT/AU85/00279

§ 371 Date: Jul. 18, 1986

§ 102(e) Date: Jul. 18, 1986

[87] PCT Pub. No.: WO86/03176

PCT Pub. Date: Jun. 5, 1986

[30] Foreign Application Priority Data

Nov. 20, 1984 [AU] Australia ..... PG8205

[51] Int. Cl.[4] ..... B65B 29/04

[52] U.S. Cl. ..... 426/80; 426/82; 426/77; 426/431; 426/433; 426/435; 206/0.5

[58] Field of Search ..... 426/77–84, 426/431, 433, 435; 206/0.5

[56] References Cited

U.S. PATENT DOCUMENTS

| | | | |
|---|---|---|---|
| 634,349 | 10/1899 | Humphrey | 426/82 |
| 2,192,605 | 3/1940 | Salfisberg | 426/82 |
| 2,606,836 | 8/1952 | McCabe | 426/80 |
| 2,614,934 | 10/1952 | Trotman | 426/83 |
| 2,698,082 | 12/1954 | Malony | 426/77 |
| 2,728,670 | 12/1955 | Young et al. | 426/82 |
| 2,728,671 | 12/1955 | Young et al. | 426/82 |
| 2,728,672 | 12/1955 | Young et al. | 426/80 |
| 3,057,729 | 10/1962 | Grant | 426/80 |
| 3,131,065 | 4/1964 | Salomon | 426/82 |
| 3,215,533 | 11/1965 | Rambold | 426/82 |
| 3,387,978 | 6/1968 | Major | 426/77 |
| 3,539,355 | 11/1970 | Kasakoff | 426/80 |
| 3,657,994 | 4/1972 | Post | 426/82 |
| 3,895,118 | 7/1975 | Rambold | 426/80 |
| 3,899,599 | 8/1975 | Rambold | 426/82 |
| 4,141,997 | 2/1979 | Syroka et al. | 426/79 |
| 4,153,153 | 5/1979 | Herzog | 426/83 |

FOREIGN PATENT DOCUMENTS

| | | | |
|---|---|---|---|
| 134383 | 2/1947 | Australia . | |
| 563756 | 7/1975 | Switzerland | 426/82 |

OTHER PUBLICATIONS

Tea and Coffee Trade J., 1/53, pp. 39, 41.

*Primary Examiner*—Steven Weinstein
*Attorney, Agent, or Firm*—Bruce L. Adams; Van C. Wilks

[57] ABSTRACT

A tea bag and cover (1), the cover having two leaves (2) and (3) with the tea bag (5) staped to one leaf (2) only below the fold line. In use the tea bag (5) is suspended in the cup with the leaf (2) outside the cup to be supported by a wedging action in cantilever fashion with the leaf (3) folded upwardly and backwardly to fully expose the top of the cup for the pouring in of the water.

9 Claims, 5 Drawing Figures

TEA BAG WITH A PROTECTIVE COVER

This invention relates to a tea bag with a protective cover, more particularly a tea bag having a protective cover which can be used to support the tea bag on the edge of a cup, jug, pitcher or other container and to protect the fingers when removing the tea bag from the cup.

BACKGROUND OF THE INVENTION

Tea bags are known which contain a quantity of tea, some of which are initially packed in a protective cover. The protective cover is then removed from the tea bag with the cover being attached by a string to the tea bag, whereby the tea bag may be easily withdrawn from a cup, teapot or the like. Alternatively, other bags have a string and tag attached, while others are simply bags with no cover or string attached.

Swiss Pat. No. 563,756 describes a tea bag which is protected by two cover leaves whereby an edge of the flat tea bag is connected to one edge of one cover leaf, and that the two cover leaves for the protective housing at the opposite edge are connected with one another. In this patent the tea bag in one embodiment is connected from the joint of the two cover leaves with the cover leaves extending across over the opposite edges of the cup to support the tea bag in the centre of the cup. This then obstructs the opening to the cup and creates difficulties in pouring the boiling water into the cup.

In the second embodiment, the tea bag is attached to one free end of one of the cover leaves. However, when such a unit is used, it is difficult if not impossible to use the cover leaves to be repositioned against the tea bag for grasping the bag to squeeze the bag to obtain the last free liquid in the bag before disposal.

U.S. Pat. No. 3,895,118 dicloses an infusion bag having a porous-walled container and a strip of nonporous sheet material secured thereto and folded about the container along a line spaced from the top edge of the container to define a portion projecting therefrom as a handle. The container is joined to the folded over portion of the strip by a staple passing through both sides of the folded over strip and the top edge of the container. Both sides are folded back and are joined together by engaging means.

The bag is not supported in the cup and in fact if the bag is too flexible, the strips themselves will be in contact with the water also no provision is made for removing the excess liquid to prevent drips during disposal.

West German Pat. No. 2,264,566 shows a similar unit to U.S. Pat. No. 3,895,118, but with the added feature that means are provided in one embodiment to support the infusion container by a flexible portion to hook over the spout of a teapot.

In another embodiment the bag is supported over the edge of the cup, with one leaf outside and the other turned upwardly. As the bag is attached by a staple passing through both leaves, the bag does not seat firmly on the cup or pitcher rim due to the rigid nature of the stapled portion of the leaves, also there is no cantilever support and the bag tends to fall into the cup or pitcher.

U.S. Pat. No. 2,192,605 describes an infusion package with a sheet of semi-stiff non-porous material crimped to the package in side by side relation to form a handle which is hooked to a container.

The sheet is hinged at both sides and both leaves are folded back to be parallel to form a handle, both leaves being bent back to form book, the lower portion of the handle being inserted into the water in the cup. It is difficult than to fold both leaves back to cover the bag to squeeze the last drops from the bag. In one alternative, the cover may be on one side only of the bag and also a narrow strip may be used, or can be provided to hook onto the cup rim.

BRIEF STATEMENT OF THE INVENTION

It is an object of this invention to provide an improved tea bag and protective cover which will protect the tea bag in packaging and storage, while providing means to support the tea bag in the liquid in the cup without obstructing the opening to the cup, which can be agitated to improve and speed up infusion, and which also can be used for safely withdrawing the tea bag from the cup for squeezing the residue and disposal of the tea bag.

Thus there is provided according to the invention, a tea bag with the a protective cover, the cover preferably being a single sheet having two leaves, the tea bag being attached to one of said leaves adjacent the centre of the sheet whereby said tea bag may be supported from a top edge of a cup or container in which the tea is to be infused, said one leaf extending down the outside of the cup with the other leaf being folded upwardly and back so that the entire opening of the cup is exposed, and for disposal the said other leaf is folded downwardly over the tea bag while it is being removed from the cup, so that it can then be squeezed if desired to complete infusion and eliminate drips and disposed of by the fingers grasping the two folded over leaves.

Thus there is also provided, according to the invention, a method of manufacturing a tea bag and cover, the tea bag having a crimped peripheral flange, the method comprising the steps of providing a sheet of paper to form the cover, stapling or otherwise fixing the tea bag to the sheet of paper at a position below the transverse centre line of the sheet and forming a fold line on the transverse centre line of the sheet to form two leaves to overlie the tea bag.

BRIEF DESCRIPTION OF THE DRAWINGS

In order to more fully describe the invention reference will now be made to the accompanying drawings in which.

DESCRIPTION OF THE PREFERRED EMBODIMENT

Figure 1:
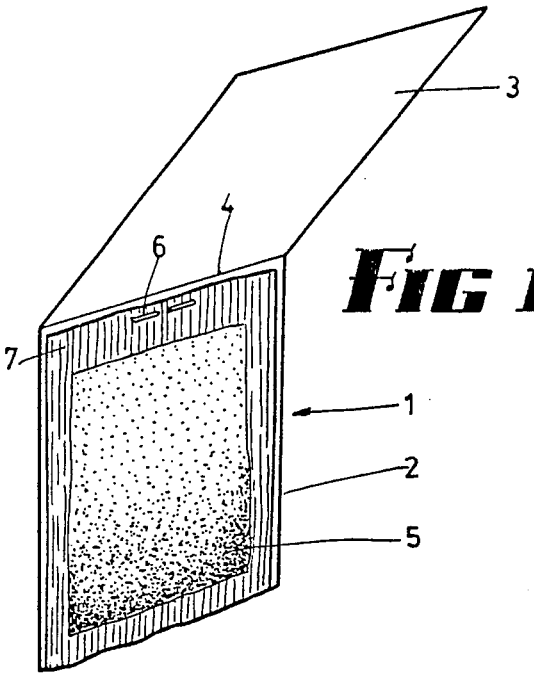
FIG. 1 is a perspective view of the tea bag and cover in an open position.

In a preferred embodiment while referring to the drawings, a cover sheet 1 comprises a first leaf 2 and a second leaf 3, the two leaves in this embodiment being separated by a hinge or common fold line 4.

A flexible infusion bag in the form of, for example, a tea bag 5 is attached by a staple, adhesive, heat sealing or the like 6 by attaching through the heat sealed or other flange portion 7 of the tea bag so that the tea bag is only attached at this point adjacent to and immediately below the fold line so that the tea bag 5 may be moved and spaced from the first leaf 2 in a hinging manner.

When the tea bag is packaged, the leaves 2 and 3 may be joined together to seal the tea bag 5 therebetween, and this may be by releasable adhesive joining the edges of the leaves 2 and 3, or by a perforated tear-off portion around the edges of the leaves 2 and 3.

Figure 2:
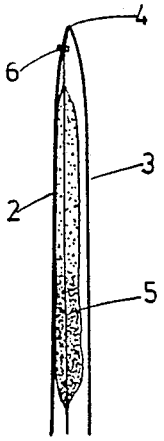
FIG. 2 is a side elevation in a folded condition.

FIG. 1 shows the tea bag in its opened out form, and FIG. 2 shows the tea bag in its folded form, for example, when the tea bag is removed from the cup.

Figure 3:
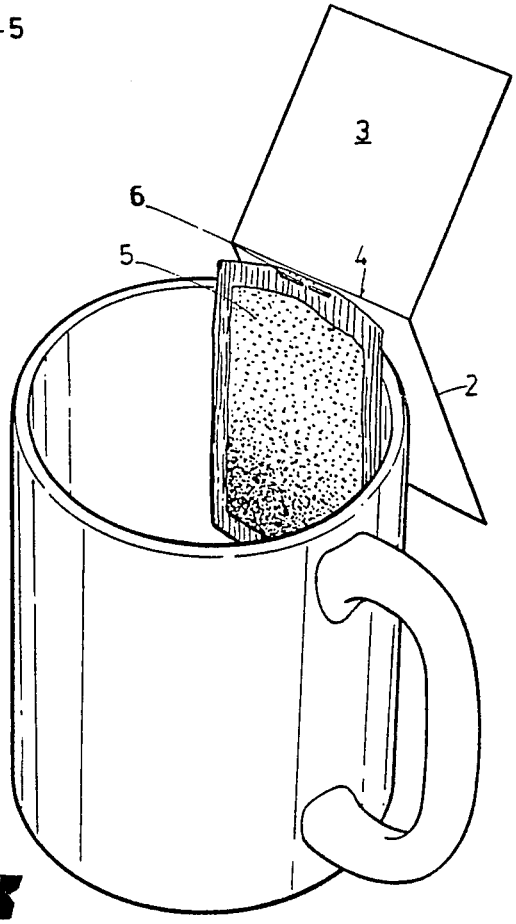
FIG. 3 shows the tea bag supported on a cup.

As shown in FIG. 3 the tea bag is inserted into the cup with the first leaf 2 extending downwardly on the outside of the cup, with the second leaf 3 being folded upwardly to be generally vertical or back thus exposing the entire open end of the cup for the pouring of the boiling water.

For removal of the tea bag, the second leaf 3 is folded downwardly over the tea bag as the tea bag is removed from the cup so that it can be squeezed if desired and then can be disposed of.

Figure 4:
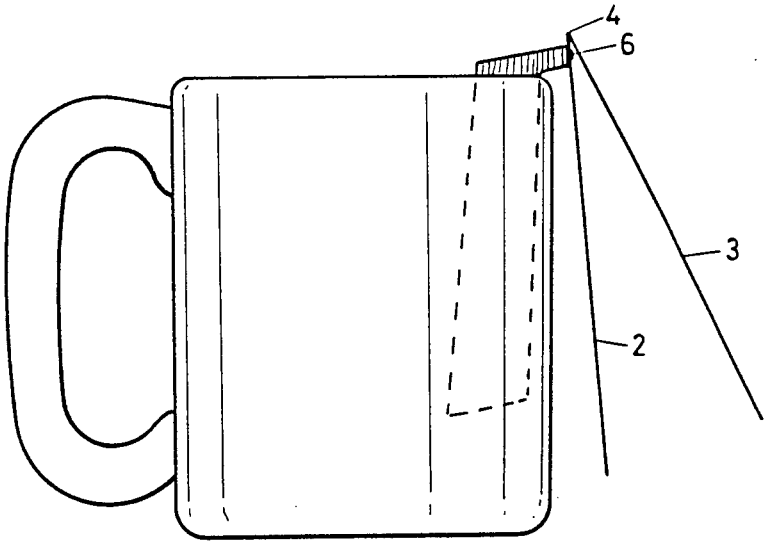
FIG. 4 shows a side elevation of the tea bag and cover positioned in the cup.
Figure 5:
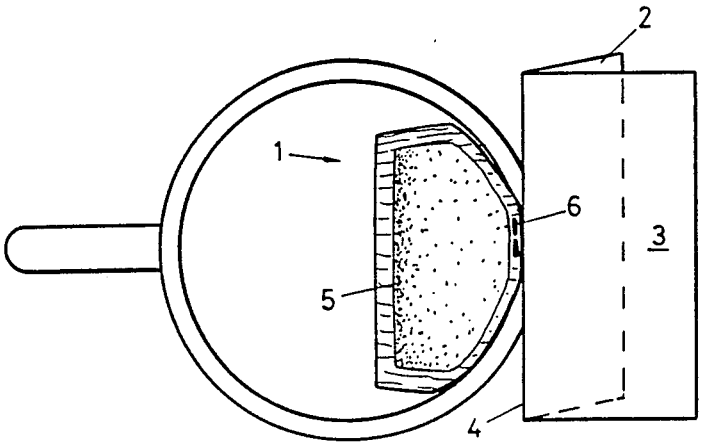
FIG. 5 is a plan view of FIG. 4.

It has been found that by utilizing a single attachment or staple 6 that the tea bag itself will then curve to follow the contours of the cup and allow the second leaf 3 to extend upwardly, or even be bent downwardly as shown in FIGS. 4 and 5.

As will be seen, due to the single attachment point of the tea bag to the leaf 2, the cup rim is in effect wedged between the curved top edge of the bag and the outer leaf 2 of the cover. This wedging thus produces a gripping effect so ensuring that the bag and cover are securely located on the top edge of the cup, the top edge of the bag moving away from the leaf 2 and thus generally conforming to the inside contour of the cup. The ends of the top edge of the bag separate from the leaf, and the bag and cover are supported by being wedged, on the one hand, by a portion of the sheet on the outside of the cup and below the staple, and on the other hand, by a portion of the bag below the upper edge thereof which curves to conform to and rest against the inside of the cup below its rim.

While a single attachment point is preferred, this may extend over a greater area, for example a pair of staples or two heat sealing points may be utilized. In all instances, by the bag being inside and the leaf outside of the cup, there is a cantilever effect to balance the bag in the wedged condition.

The cover sheet can be formed of a single piece of any suitable material, for example 80 GSM paper is entirely satisfactory, this providing sufficient heat insulation for the removal of the tea bag by the fingers, and yet has sufficient absorbency to absorb any drips or moisture coming from the tea bag while it is being disposed.

In alternative forms the cover sheet can be formed of a plastics material, a laminated material of paper and plastic or paper and metal foil, or alternatively can be of a corrugated form. It is preferred that the leaves 2 and 3 are joined by a fold line, but this is not essential and the fold line can be omitted. Also the cover sheet 1 may be formed from two separate sheets 2 and 3, these being joined together at the fold line.

In the embodiment shown, the tea bag has a heat sealed border or edge, but it is to be realized that the invention can use other forms of tea bags, for example those in which the top of the bag is closed by folding over and stapling. This staple could be used for attachment to the cover sheet of the present invention. Alternatively other forms of tea bag can be used by merely attaching the top to the cover sheet.

It will be seen that the tea bag and cover is of simple construction and can be easily and economically manufactured by feeding the bags and sheets through a stapling machine. The stapling machine may crease the sheets before or after stapling, or alternatively the sheets may be creased to form the fold line prior to feeding into the machine. Thus, there can be a single operation in the machine and this achieves advantages of economy over the prior art machines to produce the prior art bags and covers. Also economy is produced when compared with bags with strings and tags attached for removal of the bag from the cup or pot.

Not only is there reduced capital costs of the machine but also economies in the saving of material.

While the invention is particularly directed to tea bags, for infusing, either herbal teas or other forms of tea, the bag can also be used for containing ground coffee, instant coffee, soups or any other infusable or soluble material as desired in hot or cold liquid.

Also it is to be realized that while the invention has been described with particular reference to use with a cup, it is to be realized that it can also be used with other containers, such as teapots, jugs and the like. In these instances the two leaves can be extended in length and the bag be provided with an extended upper flap or flange, so that the bag would be immersed in the water. The operation in this instance would be similar to that above described.

Also the invention can be utilized for cold tea brewing in a pitcher or jug for iced tea with the bag being of larger size, such as for 3 or 4 cups. The bag can be of such a size that the bag is inserted in the water in the pitcher. Particularly when cold brewing is needed, when the tea bag is immersed over night it it virtually essential that the bag be squeezed to achieve the full flavour by removing the residue of concentrated liquor.

When the bag is to be used for brewing in large containers or pitchers, the bag will naturally be of larger size, both in width and length. In these instances, the bag can be attached to the leaf by two spaced staples. In this way the bag and leaf will bend and conform to the rim of the jug or pitcher, the spacing of the staples being thus related to the diameter of the jug or pitcher, so that the wedging effect will take place to hold the bag securely on the rim of the jug or pitcher.

Although one form of the invention has been described in some detail, it is to be realized that the invention is not to be limited thereto but can include various modifications falling within the spirit and scope of the invention.

The claims defining the invention are as follows:

1. A flexible tea bag and cover for use with a cup, the cover comprising two leaves joined together about a fold line, attachment means for attaching the tea bag to one leaf adjacent to and below said fold line whereby said fold line is above said attachment means to enable the leaves to fold to one side of the bag with no part of either leaf being on the cup side of the bag when suspended in a cup by inserting the bag inside the cup with one leaf passing down the outside of the cup and the other leaf extending away from the cup in a cantilever manner to assist in supporting the bag on the cup edge, with the flexible tea bag generally conforming to the interior surface of the cup.

2. A tea bag and cover as defined in claim 1; wherein the attachment means comprises a staple, the rim of the cup resting on the area of the bag and respectively adjacent the staple so that the bag generally conforms to the shape of the cup.

3. A tea bag and cover as defined in claim 1; wherein the cover is formed from a sheet of paper.

4. An infusion package for use with a cup comprising: a porous bag for an infusible substance; and a relatively stiff sheet of material secured at a securement region to only one side, and only at a central region along the length, of the intended top edge of the bag when the bag is suspended in a cup, thereby to enable the ends of the top edge to separate from the sheet and for the cup to support the package by being wedged, on the one hand, by a portion of the sheet on the outside of the cup and below the securement region, and, on the other hand, by a portion of the bag below the upper edge thereof which can curve to conform to and rest against the inside of the cup below its rim, said sheet extending above said securement region, and said sheet having a fold line adjacent to and above said securement region whereby said extension can be folded back away from said cup.

5. A method of infusing a substance into a liquid, in which the substance is contained in a porous bag, the bag being attached at its upper edge to a sheet of material just below a center horizontal fold line across the sheet of material to form two leaves extending down on one each side of the bag, the method comprising the steps of: folding the unattached leaf back fully; placing the bag over the rim of the cup with the attached leaf extending down the outside of the cup and with the unattached leaf extending away from the cup to assist in supporting the bag in the cup so that the edge of the cup is wedged between the bag and the attached leaf thus exposing the open area of the cup with said bag conforming to the interior surface of the cup; adding water to the cup to cover the bag so as to infuse the substance into the water; and after infusion folding the unattached leaf down as the bag is removed, the bag being held above the cup to squeeze the bag to remove excess infused liquid and disposing of the bag.

6. A flexible infusion bag and cover assembly for use with a container having a curved rim, the assembly comprising: a flexible infusion bag containing an infusible substance; a cover comprising two leaves joined together along a common fold line; and attaching means for attaching the bag at an upper center portion thereof to only one of the two leaves at an upper portion thereof adjacent to the fold line so that the bag is sandwiched between the two leaves and attached at its upper center portion to only one of the two leaves, the attaching means coating with the cover to enable the bag to be suspended in a container with said one leaf extending down the outside of the container and the other leaf folded backwardly along the fold line in a direction away from the rim of the container so that the bag is supported on the container by being wedged, on the one hand, by a portion of said one leaf on the outside of the container and, on the other hand, by a portion of the upper edge of the flexible bag which curves to conform to and rest against the inside edge of the container below the container rim.

7. A flexible infusion bag and cover assembly according to claim 6; wherein the attaching means comprises at least one staple.

8. A flexible infusion bag and cover assembly according to claim 6; wherein the cover comprises a flexible sheet of paper folded along a mid-portion thereof to define the common fold line.

9. A flexible infusion bag and cover assembly according to claim 8; wherein the two leaves of the cover have a length dimension long enough to enable the leaves to completely overlie the bag when the leaves are folded over along the fold line to sandwich the bag therebetween.

* * * * *